US007089705B1

(12) United States Patent
Lieberman

(10) Patent No.: US 7,089,705 B1
(45) Date of Patent: Aug. 15, 2006

(54) PORTABLE TOWER SYSTEM

(75) Inventor: Phillip L. Lieberman, Bixby, OK (US)

(73) Assignee: Mobile Equipment International, LLC, Tulsa, OK (US)

( * ) Notice: Subject to any disclaimer, the term of this patent is extended or adjusted under 35 U.S.C. 154(b) by 0 days.

(21) Appl. No.: 10/390,937

(22) Filed: Mar. 18, 2003

Related U.S. Application Data

(60) Provisional application No. 60/376,588, filed on Apr. 30, 2002.

(51) Int. Cl.
*E04H 12/20* (2006.01)

(52) U.S. Cl. ..... 52/146; 52/116; 52/745.17; 248/670; 343/880

(58) Field of Classification Search ..... 52/40, 52/146, 148, 152, 116, 121, 745.17; 416/DIG. 6; 174/45 R; 383/875, 880; 248/125.8, 122.1, 248/670, 346.07, 12, 158
See application file for complete search history.

(56) References Cited

U.S. PATENT DOCUMENTS

| | | | | | |
|---|---|---|---|---|---|
| 1,426,276 | A | | 8/1922 | Christie | |
| 2,105,095 | A | * | 1/1938 | Peterson | 52/63 |
| 2,581,351 | A | * | 1/1952 | Black | 52/148 |
| 2,593,246 | A | * | 4/1952 | Bender | 52/119 |
| 2,739,850 | A | * | 3/1956 | Hollingsworth | 52/121 |
| 3,008,549 | A | * | 11/1961 | Thorson | 52/120 |
| 3,368,319 | A | * | 2/1968 | Thomas et al. | 52/637 |
| 3,777,428 | A | * | 12/1973 | Caufield | 52/146 |
| 4,039,130 | A | | 8/1977 | Hogan | 248/19 |
| 4,181,929 | A | | 1/1980 | Barber et al. | 362/192 |
| 4,185,288 | A | | 1/1980 | Dosch et al. | 343/765 |
| 4,600,348 | A | * | 7/1986 | Pettit | 414/11 |
| 4,649,675 | A | * | 3/1987 | Moldovan et al. | 52/27 |
| 4,899,500 | A | * | 2/1990 | Miller et al. | 52/146 |
| 4,912,893 | A | | 4/1990 | Miller et al. | 52/79.1 |
| 5,513,829 | A | * | 5/1996 | Hodges | 248/670 |
| 5,524,398 | A | | 6/1996 | Miller et al. | 52/121 |
| 5,531,419 | A | | 7/1996 | Gustafsson et al. | 248/519 |
| 5,556,064 | A | * | 9/1996 | Cowe | 248/172 |
| 5,611,177 | A | | 3/1997 | Herbstritt | 52/111 |
| 5,808,450 | A | | 9/1998 | Chula et al. | 322/22 |
| 6,058,299 | A | | 5/2000 | Lyseng | 455/347 |
| 6,082,301 | A | * | 7/2000 | Kramer | 119/61.53 |

OTHER PUBLICATIONS

DigiWx Pamphlet. The Belfort Instrument Company.

* cited by examiner

*Primary Examiner*—Winnie Yip
(74) *Attorney, Agent, or Firm*—Fellers, Snider, Blankenship, Bailey & Tippens, P.C.

(57) ABSTRACT

A portable surveillance system having an easily transportable skid-type base structure that forms a support for a portable tower apparatus. Stabilizers are extendably mounted to the base structure. The tower components include a base member affixed to the base plate, a pivot bracket affixed to an upper end of the base member, a tower member pivotally mounted to the pivot bracket on the base member and one or more removable tower members that may be installed to achieve a desired height for the tower once it is pivoted to an upright orientation by manipulating a cable and pulley system. Various equipment mounts are provided on the tower to mount equipment such as an aerometer, a tower light, a wind direction vane, a video camera, a microwave telecom dish, or other equipment thereon. The ability to rapidly deploy the tower of invention enables rapid deployment for surveillance and other uses.

6 Claims, 2 Drawing Sheets

PORTABLE TOWER SYSTEM

CROSS REFERENCE TO RELATED APPLICATION

This application claims the benefit of U.S. Provisional Application No. 60/376,588, which application was filed with the Patent and Trademark Office on Apr. 30, 2002.

BACKGROUND OF THE INVENTION

Field of the Invention

This invention relates generally to a portable tower that may be used for quick set up of surveillance equipment or other types of equipment as desired. More particularly, the invention relates to a portable tower having an adjustable height and which is easy to manipulate into an upright position.

SUMMARY OF THE INVENTION

According to the present invention there is provided an improvement in a portable tower apparatus that may be used for surveillance or other purposes. The portable surveillance system has a base structure that forms a support for the portable tower apparatus. The base structure is preferably a portable skid type structure. Stabilization outriggers are preferably slidably mounted to the base structure. Preferably, an equipment cabinet is affixed to the base plate to house equipment such as a drop down computer shelf and a standard telecommunications rack that are used to communicate with equipment mounted on the tower. The equipment housing is preferably provided with an HVAC unit to cool the equipment. The upright tower components include a vertical base member affixed to the base plate proximate a center of the base plate, a pivot bracket affixed to an upper end of the vertical base member, a lower tower member pivotally mounted to the pivot bracket on the vertical base member and one or more removable tower members that may be installed to achieve a desired height for the tower once it is positioned in an upright orientation. The tower includes a winch used to manipulate a cable and pulley system to selectively position the tower in an upright position. A variety of equipment mounts are provided on the removable tower member to mount equipment such as an aerometer, a single obstruction tower light, a wind direction vane, a video camera, a microwave telecom dish, or other equipment.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1:
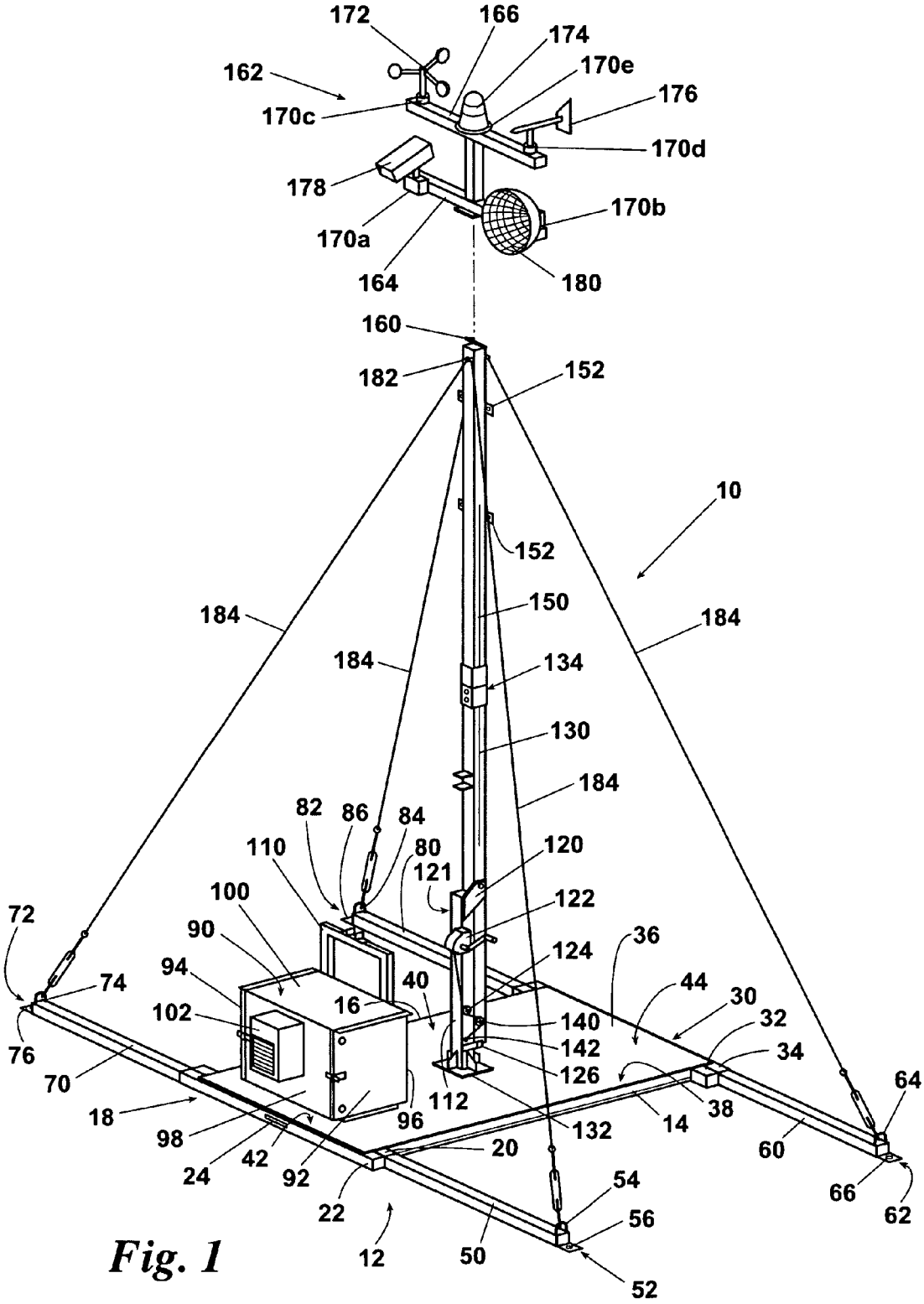
FIG. 1 is a perspective view of the portable surveillance system shown in an extended assembled configuration.
Figure 2:
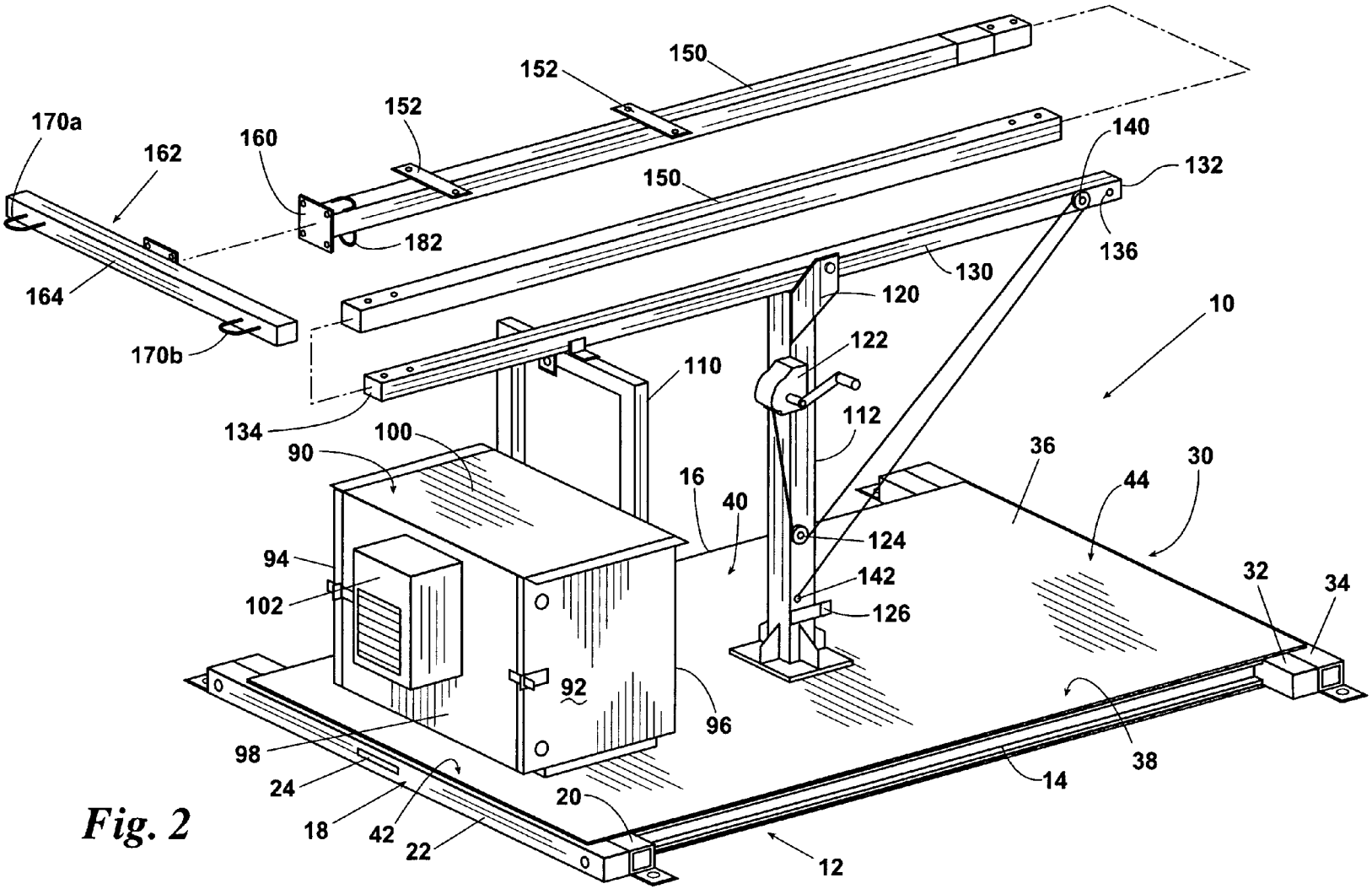
FIG. 2 is a perspective view of the portable surveillance system shown in a retracted and disassembled configuration.

Referring now to FIGS. 1 and 2, shown is a portable surveillance system designated generally 10. Portable surveillance system 10 has a base structure designated generally 12. Base structure 12 has a first longitudinal member 14 that is preferably a structural steel channel, although other materials may be used. A second longitudinal member 16 is provided parallel to first longitudinal member 14. A first pair of tubular members 18 are affixed to a first end of first longitudinal members 14 and second longitudinal members 16. Tubular members 18 are preferably formed of square tubes, although other shaped tubular members may be used. First pair of tubular members 18 have an inner tube 20 and an outer tube 22. A leveling guide 24 (FIG. 1) may be provided on outer tube 22 or at another location to assist in leveling portable surveillance system 10. A second pair of tubular members 30 are affixed to a second end of first longitudinal member 14 and to second end of second longitudinal member 16. The second pair of tubular members 30 is also made up of an inner tube 32 and outer tube 34.

A base plate 36 is affixed to base structure 12. The base plate 36 has a first side 38 adjacent to first longitudinal member 14 and a second side 40 adjacent to a second longitudinal member 16. Additionally, base plate 36 has a first end 42 adjacent to the first pair of tubular members 18 and base plate 36 has a second end 44 adjacent to the second pair of tubular members 30.

A first stabilization outrigger 50 is slidingly received within a first end of inner tube 20 of the first pair of tubular members 18 (FIG. 1). First stabilization outrigger 50 is selectively extended outwardly therefrom. The first stabilization outrigger 50 has a terminal end designated generally 52. Terminal end 52 is preferably provided with a tower guy wire point 54 and an outrigger tiedown plate 56 affixed thereto.

A second stabilization outrigger 60 is slidingly received within a first end of the outer tube 34 of the second pair of tubular members 30 (FIG. 1). Second stabilization outrigger 60 is selectively extended outwardly therefrom. The second stabilization outrigger 60 has a terminal end designated generally 62. Terminal end 62 preferably has a tower guy wire point 64 and an outrigger tiedown plate 66 affixed thereto.

A third stabilization outrigger 70 is slidingly received within a second end of the outer tube 22 of the first pair of tubular members 18 (FIG. 1). Third stabilization outrigger 70 is selectively extended outwardly therefrom. Third stabilization outrigger 70 has a terminal end designated generally 72. Terminal end 72 preferably has a tower guy point 74 and an outrigger tiedown plate 76 affixed thereto.

The fourth stabilization outrigger 80 is slidingly received within a second end of the inner tube 32 of the second pair of square tubes 30 (FIG. 1). Fourth stabilization outrigger 80 is selectively extended outwardly therefrom. Fourth stabilization outrigger 80 has a terminal end designated generally 82. Terminal end 82 preferably has a tower guy point 84 and an outrigger tiedown plate 86 affixed thereto.

An equipment cabinet 90 is preferably affixed to base plate 36 proximate first end 42 of base plate 36. However, equipment cabinet 90 may be located anywhere upon a portable surveillance system as preferred by a user. Equipment cabinet 90 is preferably formed of a frame of 4"×4" square tubing having a 1/16" sheet metal exterior. Equipment cabinet 90 preferably has a first door 92, a second door 94, an inner wall 96, an outer wall 98, and a top surface 100. Equipment cabinet 90 preferably defines an interior area having located therein a drop down computer shelf (not shown), a 19" standard telecommunications rack (not shown), and 1" styrofoam insulation covering the inner surfaces of first door 92, second door 94, inner surface of inner wall 96, inner surface of outer wall 98 and inner surface of top surface 100. In a preferred embodiment, an HVAC unit 102 is affixed to outer wall 98 for cooling the interior of equipment cabinet 90. Preferably, a 2000 BTU Dantherm Classic AC or a 2000 BTU Kooltronic AC is used, although other units may also be used. A stabilizer brace 110 is preferably affixed to inner wall 96 of equipment cabinet 90. However, stabilizer brace 110 may be positioned in other locations as desired.

A vertical base member 112 is affixed to base plate 36. Preferably, vertical base member 112 is proximate the center of base plate 36. A pivot bracket 120 is affixed to an upper end of the vertical base member 112. A second leveling guide 121 is preferably provided on an upper component, e.g. pivot bracket 120, to assist with leveling portable surveillance system 10. A tower winch 122 is affixed to the vertical base member 112. Tower winch 122 selectively retracts and extends tower winch cable 123. A base member guide pulley 124 is located on the vertical base member 112. Preferably, the base member guide pulley 124 is positioned below the tower winch 122. A ground bar 126 is affixed to a lower end of the vertical base member 112.

A lower tower member 130 is pivotally mounted to pivot bracket 120 on the vertical base member 112. Lower tower member 130 has a base end 132 and a receiving end 134. Lower tower member 130 defines a ground bar receptacle 136 (FIG. 2) for establishing a selectively interlocking relationship with ground bar 126 when the lower tower member 130 is pivoted to an upright position (FIG. 1). A tower member guide pulley 140 is located proximate the base end 132 of the lower tower member 130.

Tower winch cable 123 engages base member guide pulley 124 that is affixed to vertical base 112. Tower winch cable 123 also engages tower member guide pulley 140 located on lower tower 130. Tower winch cable 123 then attaches to attachment member 142, which is affixed to base member 112.

At least one removable tower member segment 150 is provided for selectively affixing to receiving end 134 of lower tower member 130. As shown in FIG. 2, additional removable tower segments 150 may be provided to provide a selectively adjustable height of the portable surveillance system 10. Auxiliary equipment mount 152 may be provided on the one or more removable tower members 150. A mounting pad 160 is affixed to an upper end of an uppermost removable tower member 150. A multi-module 162 may be provided for affixing to mounting pad 160. Multi-module 162 may be provided with a first mounting bar 164 (FIG. 2) or multiple mounting bars, e.g. first mounting bar 164 and a second mounting bar 166 (FIG. 1). Multi-module 162 is provided with a plurality of mounting locations, e.g. mounting locations 170*a–b* (FIG. 2) or 170*a–e* (FIG. 1). Mounting locations 170*a–d* are suitable for mounting equipment such as an aerometer 172 (FIG. 1), a single obstruction tower light 174 (FIG. 1), a wind direction vane 176 (FIG. 1), a video camera 178 (FIG. 1), a microwave telecom dish 180 (FIG. 1), or other devices used for information gathering surveillance or other purposes.

At least one guy wire mount 182 is located on at least the uppermost removable tower member segment 150. Guy wires 184 (FIG. 1) are affixed to the guy wire mount 182 and to the tower guide points 54, 64, 74, 84 which are located at the terminal ends 52, 62, 72, 82 of telescopic stabilization outriggers 50, 60, 70 and 80.

In practice, the portable surveillance system 10 of the invention may be rapidly deployed in a desired location for a variety of purposes including weather monitoring, observation or communications. Other uses include quick set up of surveillance at airports or other facilities that may required increased security. In use, the portable surveillance system 10 is transported to and positioned at a desired location. First stabilization outrigger 50, second stabilization outrigger 60, third stabilization outrigger 70 and fourth stabilization outrigger 80 are extended from their positions within tubular members 20, 22, 32 and 34. Portable surveillance system 10 is then leveled by using leveling guides 24 and 121. Before raising lower tower member 130, a user should determine the desired height of the portable surveillance system 10. Then, one or more removable tower member segments 150 may be installed accordingly.

First, a removable tower segment 150 is inserted into receiving end 134 of lower tower member 130 and secured thereto. Second, additional removable tower segments 150 may be installed if desired. Finally, a mounting pad 160 should be secured to an upper end of the uppermost removable tower segment 150. At this time, a desired piece of equipment such as an aerometer 172, a wind direction vane 176, a video camera 178, a telecom dish 180 or another piece of equipment may be installed on mounting pad 160 as desired. Alternatively, a multi-module 162 may be provided with one or more of an aerometer 172, tower light 174, a wind direction vane 176, a video camera 178, a microwave telecom dish 180 or other measurement or observation equipment installed on multi-module 162. Multi-module 162 is then secured to mounting pad 160. If it is desired to mount additional equipment upon the portable surveillance system 10 then additional equipment may be secured to auxiliary equipment mounting location 152. If desired, outrigger tiedown plates 56, 66, 76 and 86 may be used to secure the portable surveillance system 10 to a location with either stakes, bolts or other means.

To set up portable surveillance system 10 in an upright position, lower tower member 130 is pivoted about pivot bracket 120 and away from stabilizer brace 110 with tower winch 122. By spooling winch cable 123 onto tower winch 122, tower winch cable 123 acts to pull tower member guide pulley 140 towards base member guide pulley 124. This continues until lower tower member 130 is vertically oriented. At this time ground bar 126 may be used to engage ground bar receptacle 136 on a lower end of lower tower member 130 thereby securing lower tower member 130 in a vertical orientation.

Once the lower tower member 130 and tower member segments 150 are raised into an upright position (FIG. 1) with equipment and/or multi-module section 162 affixed thereto, guy wires 184 may be affixed to guy wire mount 182 and to each of tower guide wire points 54, 64, 74 and 84 on stabilization outriggers 50, 60, 70 and 80.

Instruments 172, 176, 178, 180, or other instruments communicate data to a processing and storing device located within equipment cabinet 90. Preferably, equipment cabinet

90 is provided with HVAC unit 102 to keep processing and memory storage devices at an appropriate temperature. HVAC unit 102, computing and storage devices and equipment 172, 176, 178, 180, or other instruments may be provided with external power, or with an onsite generator. If appropriate, equipment 172, 176, 178, 180, or other instruments may be powered with batteries and/or solar power or by other devices.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. A portable surveillance system comprising:

a portable base structure;

a selectively extendable stabilizer extendable from said base structure;

a tower secured to said base structure and extending vertically therefrom; and wherein said base structure comprises:

a first longitudinal member;

a second longitudinal member parallel to said first longitudinal member;

a first pair of tubular cross members that engage said first longitudinal member and said second longitudinal member, said first pair of tubular cross members having an inner tube and an outer tube;

a second pair of tubular cross members that engage said first longitudinal member and said second longitudinal member, said second pair of tubular cross members having an inner tube and an outer tube; and a base plate affixed to one of said first longitudinal member, said second longitudinal member, said first pair of tubular cross members and said second pair of tubular cross members.

2. The portable system according to claim 1 wherein said stabilizer member comprises:

a first stabilization outrigger slidingly received within said inner tube of said first pair of tubular cross members for selectively extending outwardly therefrom;

a second stabilization outrigger slidingly received within said outer tube of said second pair of tubular cross members for selectively extending outwardly therefrom;

a third stabilization outrigger slidingly received within said outer tube of said first pair of tubular cross members for selectively extending outwardly therefrom; and a fourth stabilization outrigger slidingly received within said inner tube of said second pair of tubular cross members for selectively extending outwardly therefrom.

3. The portable system according to claim 2 further comprising:

a guy wire point on a terminal end of at least one of said stabilization outriggers;

a guy wire affixed to said guy wire point at said terminal end of said stabilization outrigger; and said guy wire affixed to an upper end of said tower.

4. A portable surveillance system comprising:

a portable base structure;

a selectively extendable stabilizer extendable from said base structure;

a tower secured to said base structure and extending vertically therefrom;

a vertical base member affixed to said base structure;

a pivot bracket affixed to an upper end of said vertical base member;

a tower member pivotally attached to said pivot bracket on said vertical base member;

a tower winch affixed to said vertical base member;

a base member guide pulley on said vertical base member below said tower winch;

a tower member guide pulley proximate a lower end of said tower member;

an attachment member proximate a lower end of said vertical base member; and a cable attached at a first end to said attachment member, said cable passes over said tower member guide pulley, over said base member guide pulley, said cable having a second end affixed to said tower winch, wherein winding said cable on said tower winch causes said lower end of said tower member to move towards said lower end of said vertical base member, thereby raising said tower member to an upright position.

5. The portable system according to claim 4 wherein said tower comprises:

a ground bar affixed to said lower end of said vertical base member for securing said lower end of said tower member to said lower end of said vertical base member when said tower member is pivoted to an upright position.

6. A portable surveillance system comprising:

a portable base structure;

a selectively extendable horizontal stabilizer telescopically extendable from said base structure;

a tower secured to said base structure and extending vertically therefrom;

wherein said stabilizer has a terminal end having tower guy wire point for receiving a lower end of a tower guy wire;

a mounting pad affixed to an upper end of said tower; and a multi-module for selectively affixing to said mounting pad, said multi-module having a first mounting bar for supporting selected equipment thereon; and a second mounting bar, said second mounting bar having mounting locations suitable for equipment selected from a group consisting of an aerometer, a tower light, a wind direction vane, a video camera, and a microwave telecom dish.

* * * * *